US006587084B1

(12) United States Patent
Alymov et al.

(10) Patent No.: US 6,587,084 B1
(45) Date of Patent: Jul. 1, 2003

(54) DRIVING METHOD OF A PLASMA DISPLAY PANEL OF ALTERNATING CURRENT FOR CREATION OF GRAY LEVEL GRADATIONS

(75) Inventors: Youri Nikolaevich Alymov, Ryazan (RU); Victor Markusovich Gutman, Ryazan (RU); Anatoly Borisovich Pokryvailo, Ryazan (RU)

(73) Assignees: Orion Electric Co., Ltd. (KR); Research & Production Company "Orion-Plasma" (RU)

( * ) Notice: Subject to any disclaimer, the term of this patent is extended or adjusted under 35 U.S.C. 154(b) by 0 days.

(21) Appl. No.: 09/486,598

(22) PCT Filed: Jul. 10, 1998

(86) PCT No.: PCT/KR98/00204

§ 371 (c)(1),
(2), (4) Date: Feb. 29, 2000

(87) PCT Pub. No.: WO00/03379

PCT Pub. Date: Jan. 20, 2000

(51) Int. Cl.[7] ..... G09G 3/28; G09G 3/10

(52) U.S. Cl. ..... 345/60; 345/63; 345/72; 345/41; 345/37

(58) Field of Search ..... 345/41, 42, 60, 345/63, 72, 37

(56) References Cited

U.S. PATENT DOCUMENTS 3,906,290 A 9/1975 Kurahashi et al.

5,541,618 A 7/1996 Shinoda

FOREIGN PATENT DOCUMENTS

EP 0 488 326 A2 11/1991
EP 0 845 769 A1 10/1997

*Primary Examiner*—Steven Saras
*Assistant Examiner*—Alecia D. Nelson
(74) *Attorney, Agent, or Firm*—Merchant & Gould P.C.

(57) ABSTRACT

The present invention provides a gray level display AC-type PDP driving method comprising (a) dividing a single image frame into n number of subframes, each of the subframes having predetermined number of sustaining pulses; (b) selecting scan electrodes whose number is identical to the number of said subframes, assigning specific subframes to said selected scan electrodes, sequentially providing scanning pulses having different phases on said selected scan electrodes and applying addressing pulses on said data electrodes in order to designate pixels to be displayed, and alternately supplying the predetermined number of sustaining pulses onto the selected scan electrodes and said data electrodes, to thereby display said assigned subframes for said selected display lines; (c) shifting by one or more than scan electrode(s) from each of said selected scan electrodes; and (d) repeating said shifting of step (c) and displaying of said assigned subframes until each of said divided subframes is displayed for all the display lines, to thereby display a image frame. According to the present invention, it is possible to eliminate a suspending time and to provide advantages of advanced driving stability, high luminance and improved contrast.

8 Claims, 10 Drawing Sheets

DRIVING METHOD OF A PLASMA DISPLAY PANEL OF ALTERNATING CURRENT FOR CREATION OF GRAY LEVEL GRADATIONS

FIELD OF THE INVENTION

The present invention relates to a plasma technique; and, more particularly, to a method and an apparatus, for use in a display system such as a TV plasma video module employing an AC-type plasma display panel, for driving an AC-type plasma display panel capable of displaying a gray level.

DESCRIPTION OF THE PRIOR ART

A plasma display panel (referred to as "PDP" hereinafter) is a device which displays letters or pictures by using light emitted from plasma generated during gaseous discharge. The PDP is classified into a DC-type and an AC-type depending on a driving method for providing electric field thereto in order to make the plasma.

Since the PDP has advantageous characteristics such as large screen size more than 40 inches, ability to display full-color images and wide viewing angle compared with other flat panel devices, it results in a rapid increase in its application area such a next generation HDTV capable of hanging on the wall and a multimedia display apparatus combining a TV and a personal computer.

There are several methods for driving the AC-type PDP. One of the methods is disclosed in U.S. Pat. No. 5,541,618, assigned to Fujitsu Limited. An address display period separated (ADS) sub-field method disclosed in same will be illustrated hereinafter.

In accordance with the above patent, one image frame is divided into n number of subframes. Each of the subframes includes: an addressing period subsequently providing scan pulses to all scan electrodes in order to indicate cells to be lit; and a display period having a predetermined sustain pulses and concurrently applying sustain pulses to all the scan electrodes, wherein a number of the sustain pulses is predetermined differently for each subframe.

As shown above, the scan pulses are continuously provided onto all the scan electrodes and address pulses are applied onto data electrodes in response to picture data to be displayed. However, according to the ADS sub-field method, since every subframe should have an addressing period for addressing all the scan lines, the display period is relatively shortened. Therefore, the brightness of an image may be decreased.

For example, in order to prevent users from feeling flickers on the screen, the time for controlling illumination of one frame should be limited about 1/60 sec or less, namely 16.67 ms. In NTSC system having 480 scan lines, if one image frame is divided into 8 number of subframes, it takes about 11 to 12 ms in addressing one image frame. Because the remaining time for the display period which TV viewer can substantially recognize the image is only 5 to 6 ms, the efficiency becomes only 30% and the brightness of the image is reduced. However, if increasing frequency of sustain pulse in order to compensate the brightness reduction, power consumption is increased and reliability of driving is also decreased.

In particular, in case of HDTV having 1024 scan lines, because it takes about 24 to 25 ms in addressing one image frame, there is no the remaining time for the display period. As a result, the TV viewer cannot recognize the image. Also, since pixels corresponding to scan electrodes are continuously selected for an addressing period, the reliability of driving is reduced by a result of static delay effect which occurs in discharge firing.

There have been proposed another AC-type PDP driving method for providing a gradation of the display brightness, such as the article by Nakamura A. O. "Drive for 40-in.-Diagonal Full-Color as Plasma Display" SID 95 DIGEST pp. 807–810. According to the above method, one image frame is divided with time into n number of subframes which of each have a predetermined number of sustain pulses, each subframe includes a single display period for applying a predetermined number of sustain pulses to all the scan electrodes and an addressing period in which primary discharges is simultaneously created in pixels corresponding to scanning electrode group, thereafter scanning pulses are sequentially formed on all scanning electrodes of this group, similarly, formation of primary discharge and scanning pulse are accomplished for other groups of scanning electrodes.

Problem in the above method disclosed in "SID 95 DIGEST" is in that since each subframe should has a addressing period for all scan electrodes, a display period for sustaining an image frame is inevitably reduced, consequently brightness of an image is reduced. In this case, increasing frequency of sustain pulse in order to partially compensate the brightness reduction may causes increase of power consumption and reduction of driving reliability.

Another method for displaying a picture half-brightness (gray scale) is disclosed in U.S. Pat. No. 3,906,290 by Koichiro K. et al. A halftone picture display can be achieved according to two methods, the first being that the mean brightness of the picture element or luminescent dot be made proportional to the turn-on period. The second method is that the mean brightness of the picture element or luminescent dot for the turn-on period be made proportional to the frequency of the sustaining voltage.

Several embodiments are disclosed which incorporate one or both of the foregoing principles to achieve a halftone display.

However, in the above method, there is the fact that the image sharpness and the brightness are reduced. To achieve an image of good quality, the number of subelement in a pixel should be larger, their brightness should be differently set.

Furthermore, according to the above method by Koichiro K. et al., one image frame is divided into n number of subframes, each subframe having a predetermined number of the sustain pulses. Here, scan pulses are provided onto scan electrodes and address pulses are applied onto data electrodes in response to picture data to be displayed.

To realize above method in an AC-type PDP driving circuit, it is necessary to have a plurality of multi-discharge shift registers on logic inputs of scanning pulse drive with complicated logic circuit of connection of their outputs, and it reduces reliability of driving and also rises cost of the device.

Also, there is another driving method of the AC-type PDP for displaying grey level gradation which is disclosed in EP patent No. 0,488,326A2 and developed by NEC Corporation in Japan. According to the driving method of NEC, one field is divided into n number of subfields, all of the second to last subfields have equal period T's, and the first subfield has period 2T's. All subfields also have different light emission periods, namely T', T'/2, T'/4, T'/8, . . . , respectively.

According to this method, although the brightness of an image becomes about 78.8%, since the light emission periods of some subframes have relatively small periods and all pixels corresponding to given scanning electrode are in "off" states, the efficiency of an image frame used for displaying cannot be increased more than 78.8%.

SUMMARY OF THE INVENTION

It is, therefore, a object of the present invention to provide a gray level display AC-type PDP driving method capable of achieving high sharpness of an image, high brightness and improved reliability by eliminating the before-mentioned problems.

In accordance with one aspect of the present invention, a method for driving an AC-type plasma display panel comprising two substrates separated from each other, display electrodes and scan electrodes disposed on one of said two substrates in parallel, a plurality of display lines consisting of one scan electrode and one or more display electrodes, a dielectric layer covering the display and the scan electrodes, data electrodes disposed on the other of said two substrates, substantially orthogonal to said display lines, a number of pixels formed on crossing points of a display line and a data electrode, spacers formed on one or both of said substrates to partition said pixels, and gas filled in a space between the two substrates, said method comprising the steps of: (a) dividing a single image frame into n number of subframes, each of the subframes having predetermined number of sustaining pulses; (b) selecting display lines whose number is identical to the number of said divided subframes, assigning specific subframes to said selected display lines, sequentially providing scanning pulses having different phases on the scan electrodes of said selected display lines and at the same time applying addressing pulses on is said data electrodes in order to designate pixels to be displayed, and alternately supplying the predetermined number of sustaining pulses onto the selected scan electrodes and said commonly connected display electrodes, to thereby display said assigned subframes for each of said selected display lines; (c) shifting by one or more than display lines from each of said selected display lines, and (d) repeating said shifting of step (c) and displaying of said assigned subframes for selected display lines of step (b) until each of said divided subframes is displayed for all the display lines, to thereby display a image frame.

In accordance with another aspect of the present invention, there is provided a method for driving an AC-type plasma display panel capable of displaying gray levels of an image frame which is divided into n number of subframes, each subframe having predetermined sustain periods, wherein, for each subframe, scan pulses are provided onto selected scan electrodes and addressing pulses are supplied onto data electrodes in response to display information, comprising: the number of sustain pulses, included in two adjacent subframes among the subframes, determined as:

$$R \geqq 2S/(n+2)$$

wherein R is the number of sustain pulses; S represents the total number of sustain pulses within the image frame; and n depicts the number of the subframes, the number of sustain pulses in a subframe being of an odd number.

BRIEF DESCRIPTION OF THE DRAWINGS

The foregoing and other objects, features and advantages of the present invention will become apparent from the following detailed description of preferred embodiments of the invention with reference to the accompanying drawings, in which.

DETAILED DESCRIPTION OF THE PREFERRED EMBODIMENTS

The embodiments of the present invention will be illustrated in detail with reference to the accompanying drawings.

Figure 1:
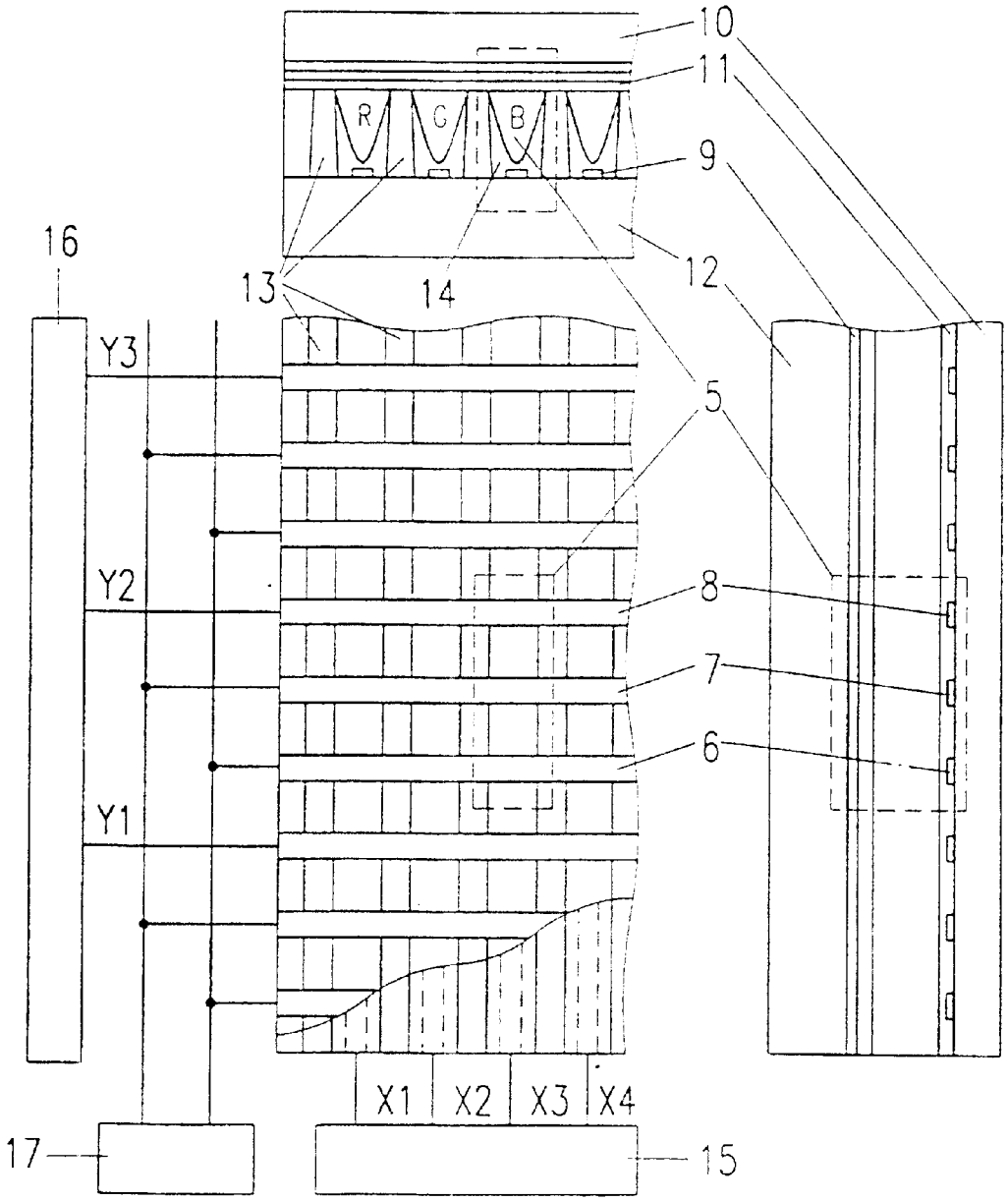
FIG. 1 represents a structure of a 4 electrode surface discharge AC-type PDP driving apparatus in accordance with the present invention.

Referring to FIG. 1, there is represented a structure of a gray level display AC-type PDP driving apparatus in accordance with the present invention. In FIG. 1, each pixel 5 comprises a first display electrode 6 and a second display electrode 7 which are disposed in parallel with each other; a scan electrode 8 located close to the second display electrode 7; a data electrode 9 crossing perpendicular to the first and the second display electrodes 6 and 7 and the scan electrode 8. The first and the second display electrodes 6 and 7 and the scan electrode 8 are formed under an upper glass plate 10 and covered by a dielectric layer 11. The data electrode 9 is disposed between spacers 13 on a lower glass plate 12, orthogonal to the first and the second display electrodes 6 and 7 disposed on the upper glass plate 10, and covered by three fluorescent layers 14 each emitting red(R), green(G) and blue(B) lights. The spacers 13 can be formed in the form of a stripe or a matrix and a pixel is formed on a crossing point between the display electrodes and the data electrode. Space between the upper glass plate 10 and the lower glass plate 12 is filled with a mixed gas of, e.g, Ne, He and Xe, and thereafter sealed. In this panel, one display line consists of a first and a second display electrodes and a scan electrode, and a pitch of a pixel is set such as e.g., 1.05 mm.

The data electrodes 9 are connected to a data driver 15, which provides positive addressing pulses to the data electrodes 9 in response to information to be displayed within a given sustain period. The scan electrodes 8 are connected to a scan electrode driver 16, which provides scan pulses to all of scan electrodes 8 selected in the given sustain period. All of the first and the second display electrodes 6 and 7 are united into two groups and connected to a sustain pulse generator 17, which provides sustain pulses for each subframe.

Figure 7:
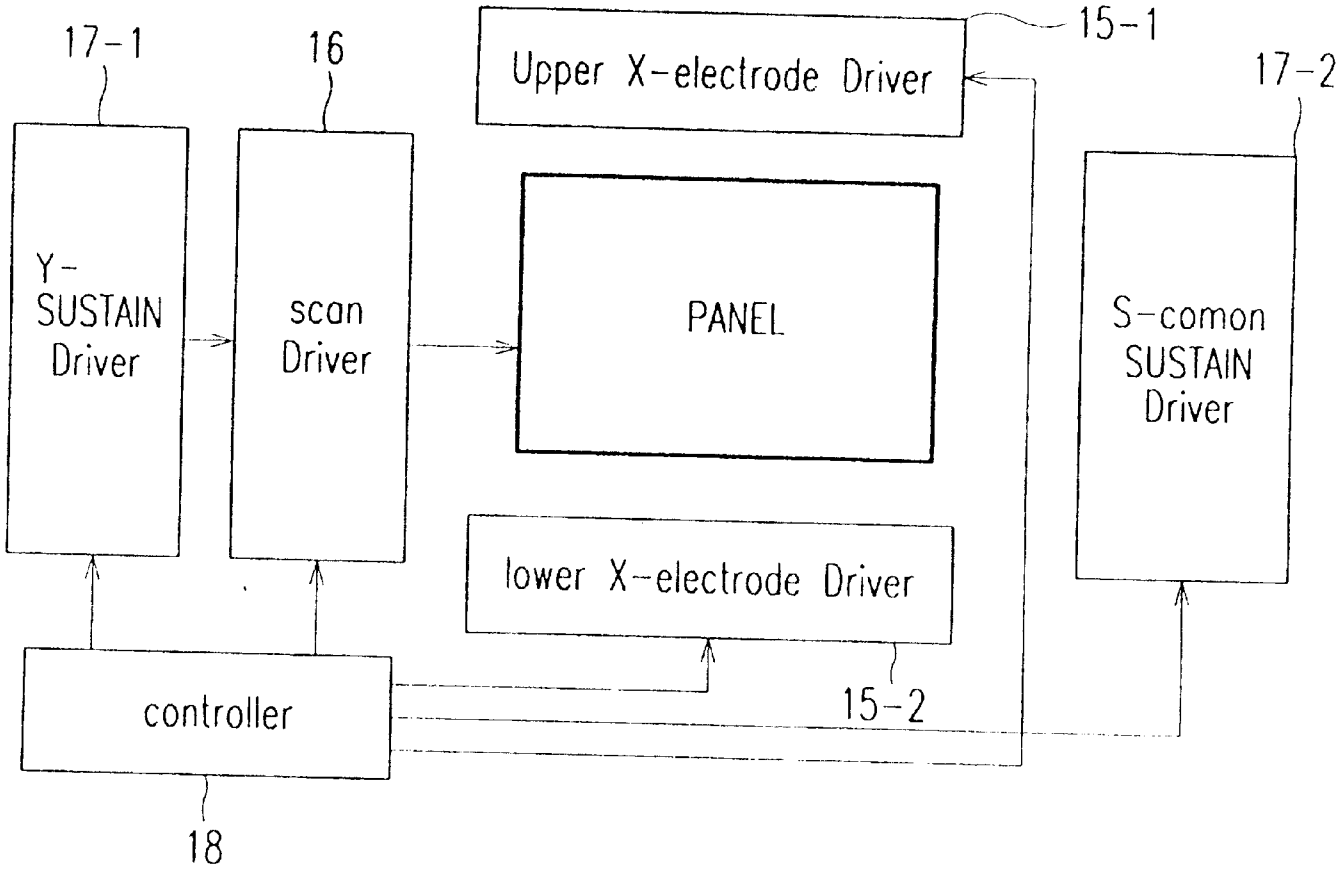
FIG. 7 is a schematic block diagram of an AC-type PDP driving apparatus in accordance with the present invention.

FIG. 7 is a schematic block diagram of an AC-type PDP driving apparatus. This apparatus comprises a scan driver 16 for sequentially providing scan pulses onto the scan electrodes; upper and lower X-electrode driver 15-1,15-2 for providing addressing pulses in response to display data; a sustain driver 17-1,17-1 for supplying sustain pulses onto the display electrodes; and a controller 18 for controlling pulse timing of all drivers.

Figure 2:
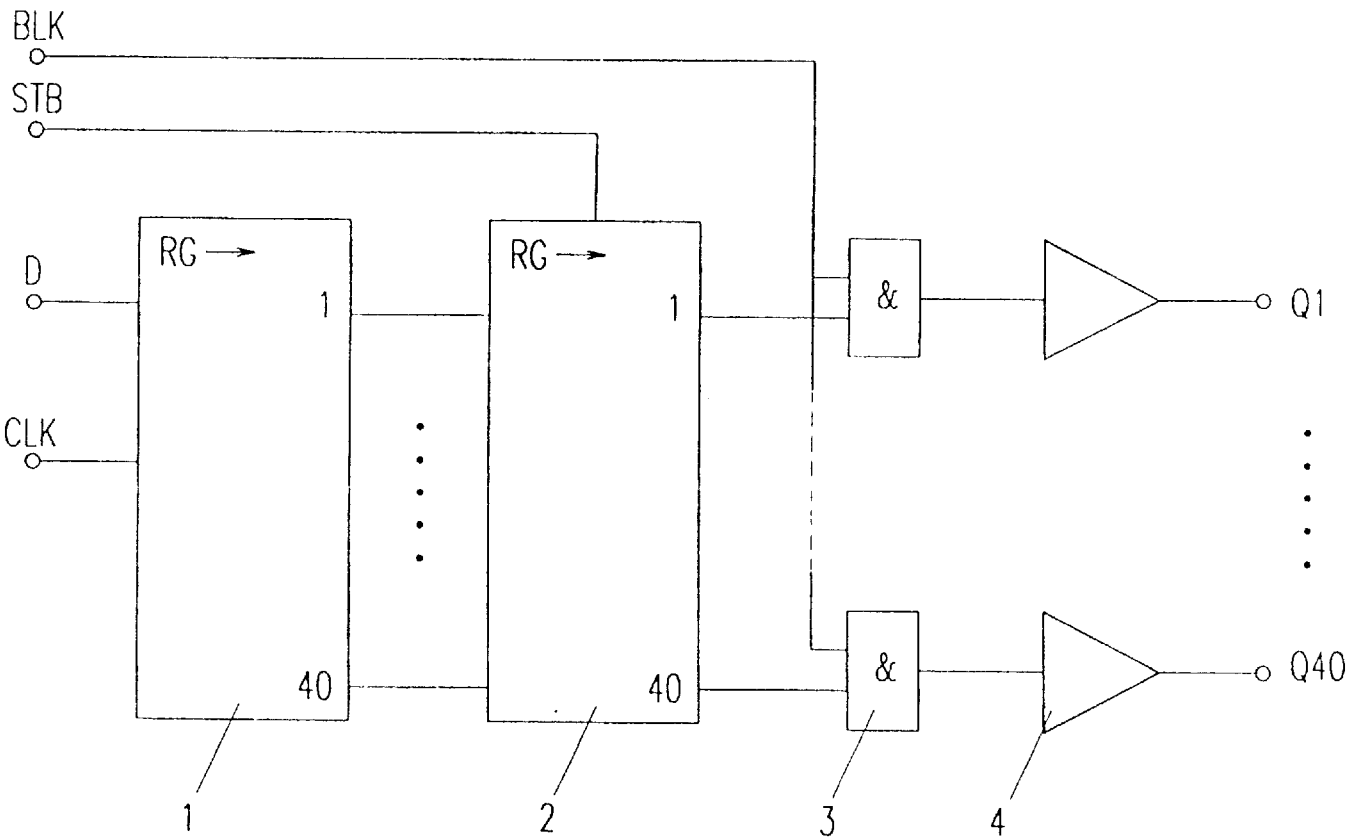
FIG. 2 shows a schematic block diagram of a control micro circuit, for use in the scan electrode driver in FIG. 1, for generating scan pulses.

Referring to FIG. 2, there is shown a schematic block diagram of a control micro circuit for use in the scan driver in FIG. 1 or 7 for generating scan pulses. The outputs of control micro-circuits correspond to output terminals Y1, Y2 and Y3 . . . of the scan driver 16. The control micro-circuit shown in FIG. 2 can be used such as e.g $\mu$ PD16305 developed by NEC Corporation which comprises a 40 stage shift register 1 having a CLK input and D data input for entry of input information which the latter being shifted later by a clock pulse. Information output from the shift register 1 is written on a register-latch 2 by means of a pulse input from STB input. Information output from the register-latch 2 is provided to a first input terminal of each of coincidence circuits 3, which have respective second input terminal, i.e. a BLK input terminal for providing a blank pulse. Information output from the register-latch 2 and blank pulse from a BLK input terminal is coupled by coincidence circuit 3, the coupled information is provided to respective output drivers 4 for forming scan pulses at the output terminals Q1 to Q40.

The driving principle according to the present invention will be illustrated hereafter by the above mentioned devices. The AC-PDP driving method for displaying gray level gradation comprises: dividing an image frame into n number of subframes; and setting the predetermined number of sustaining period for each subframe wherein scan pulses are applied on scan electrodes to be selected and address pulses are applied on data electrodes in accordance with information to be displayed. Also, the total number of sustaining periods(R) for any two adjacent subframes of continuous subframes is set by the empiric ratio as follows:

$$R \geqq 2S/(n+2)$$

where S is total number of sustaining periods in an image frame, the number of sustaining periods in any subframe is odd.

The scan pulses are generated on the scan electrodes by the control micro-circuits having "γ" outputs, respectively. In a given sustaining period, scanning pulses is formed only on any one of outputs of the control micro-circuits. The "γ" value is determined by the condition $\gamma \leqq R/2$. The scan electrodes only of the same name(even or odd) are separately connected to one control micro-circuit.

Setting the total number of sustaining periods(R) for any two adjacent subframes of continuous subframes by the ratio $R \geqq 2S/(n+2)$ and odd number of sustaining periods in any subframe make it possible to select numbers of the scan electrodes which are distinguished even number with odd number at least by R, to use control micro-circuits with a large number of outputs "γ" and to provide improved driving reliability.

Formation scanning pulses only on one of the control micro-circuit outputs in given sustaining periods makes it possible to carry out selection of all scan electrodes without change of data to be written in the shift registers of the control micro-circuits, and it reduces the rate of data entry in the registers and improves driving reliability.

Figure 3:
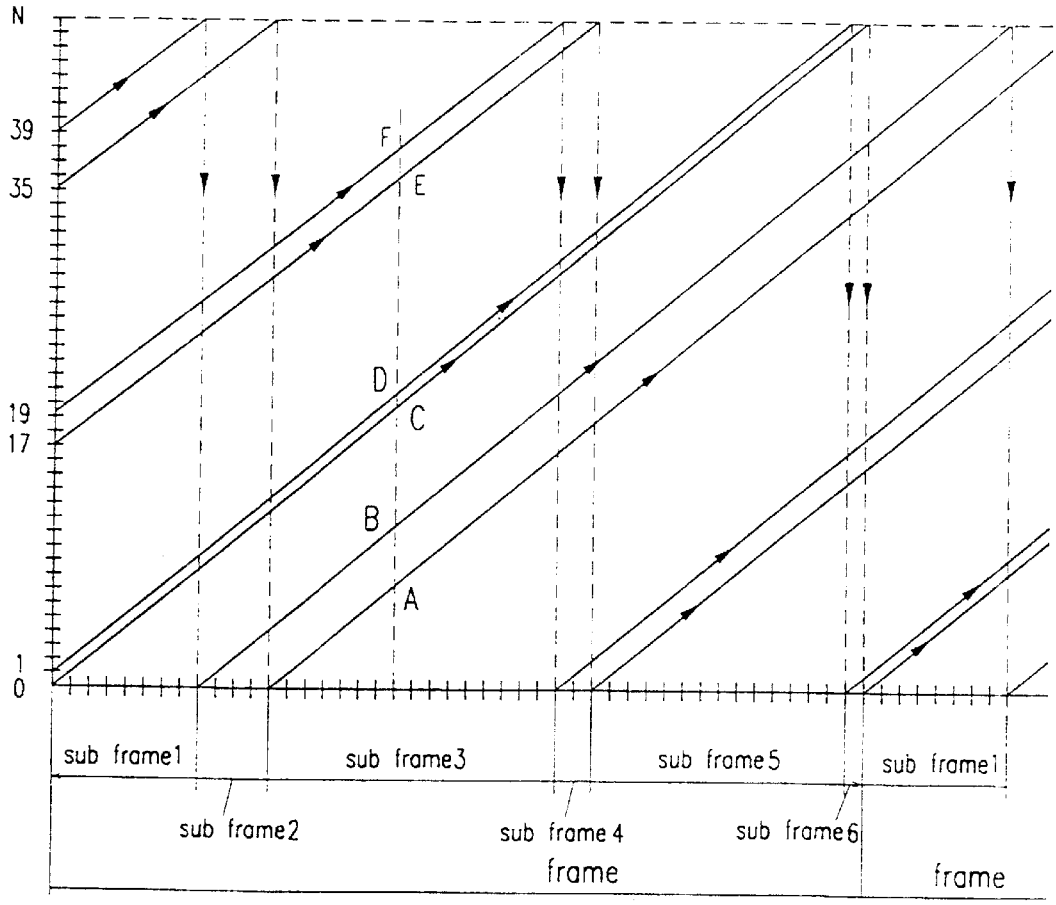
FIG. 3 is a timing diagram of an image frame division in accordance with a driving method of the present invention.

Referring to FIG. 3, there is illustrated a timing diagram of an image frame division in accordance with a driving method of the present invention. A single image frame is divided into n(e.g in FIG. 1 n=6) number of subframes, and a predetermined number of sustaining periods for each given subframe is set as S. The number of scan electrodes of PDP is N and, in general, it has to satisfy a condition $S \geqq N$. Sloping lines whose number is identical to the number of the subframes, schematically represents the number of scan electrodes to be selected in a given sustaining period. For example, during a sustaining period corresponding to number I, 6 number of the scan electrodes, i.e., A, B, C, D, E and F, are selected. In the following sustaining period, these numbers are increased until they reach to N, thereafter each of the sloping lines begins again from first scan electrode, as can be seen by an arrow for one of the sloping lines. In the time of a scan electrode selection, change in the state of all pixels relating to this electrode is made in accordance with information to be displayed, that is whether the given pixel in the given subframe shall be in "ON" state or "OFF" state.

The selection of a pixel state is performed by generating a scan pulse on a selected scan electrode and a addressing pulse on a selected data electrode. Then, the predetermined state of the pixel is maintained by sustaining pulses up to next selection of the same scan electrode.

In accordance with an embodiment of the present invention, a definite order of the subframes alternation (interlacing) is set in any two adjacent subframes of continuous subframes for example, in the first and the second subframes in the given image frame or the sixth subframe in the given image frame and the first subframe in the next image frame, the total number of sustaining periods R is set as greater than the predetermined value selected from an experimental ratio $R \geqq 2S/(n+2)$.

Items of R corresponding to S and n are shown in Table 1.

TABLE 1

| s | 480 | | | 576 | | |
|---|---|---|---|---|---|---|
| n | 6 | 8 | 10 | 6 | 8 | 10 |
| R | 120 | 96 | 80 | 144 | 115 | 96 |

If the number of the sustaining periods is maintained as an odd number in accordance with the embodiment of the present invention, in case of S=480 and n=10, a sequence of the numbers of pulses in a subframe is 87, 3, 87, 5, 87, 9, 87, 17, 65 and 33 and, according to the above sequence, it is possible to accomplish luminance of 252 gray levels.

Odd scan electrodes and even scan electrodes are separately connected to the control micro-circuit and total number of sustaining pulses of adjacent subframes has to be larger than or equal to 82. Therefore, it is possible to make scan pulses by using a control micro-circuit having 40 outputs and also to achieve the display efficiency of 100% for a single image frame as shown in FIG. 3.

Figure 4:
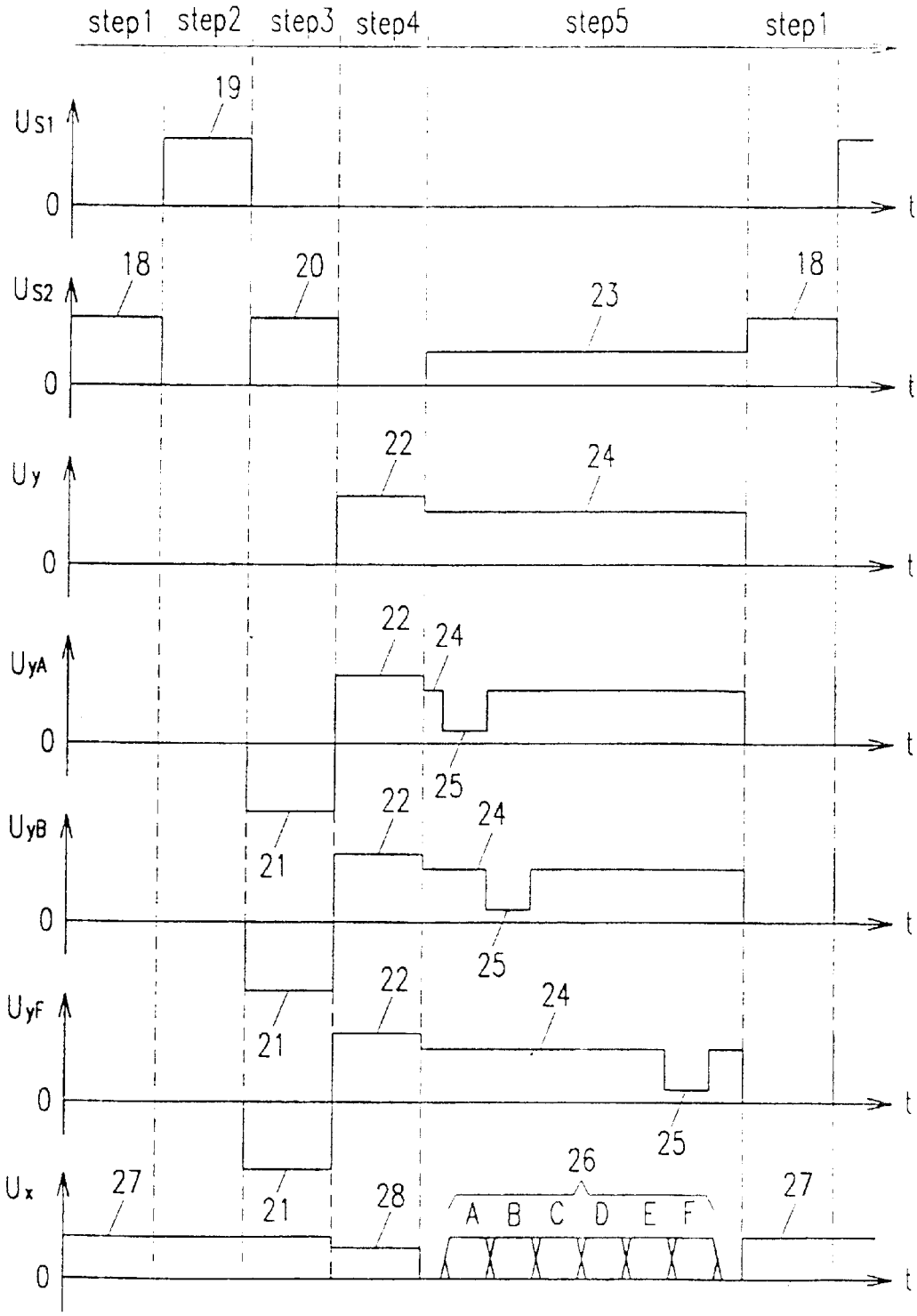
FIG. 4 depicts a timing diagram of voltage pulses on electrodes of the PDP in accordance with the present invention.

In each sustaining period, voltage pulses are provided on electrodes of the PDP according to a timing diagram as shown in FIG. 4. In FIG. 4, a reference code Us1 represents a voltage value of a sustaining pulse provided on the first display electrode 6; Us2 depicts a voltage value of a sustaining pulse supplied on the second display electrode 7; and Uy describes a voltage value of a scanning pulse applied on the scan electrode 8. Reference codes UyA, UyB, . . . , UyF represent voltage values of scanning pulses generated on selected scan electrodes(i.e., electrodes located at A, B, . . . , F in FIG. 3) and Ux depicts a voltage value of addressing pulses applied onto the data electrode 9.

At step 1, the positive sustaining pulse 18 is applied on the second display electrodes 7. At step 2, the positive sustaining pulse 19 is supplied on the first display electrodes 6. Then, at step 3, the positive sustaining pulse 20 is applied on the second display electrodes 7 and, at the same time, a negative scanning pulse 21 which is produced at the scan electrode driver 16 is applied onto all of scan electrodes, e.g., electrodes located at A, B, . . . , F in FIG. 3, selected in a given period. At step 4, the sustaining pulse 22 is provided on all of the scan electrodes. At step 5, a definite level of positive voltage 23 is applied onto all of the second display electrodes 7 and at the same time, a positive voltage 24 having level not exceeding that of the sustaining pulse 22 is provided on the scan electrodes; the scanning pulse 25 are sequentially supplied on the scan electrodes selected at step 3; and the addressing pulses 26 is supplied on the data electrodes 9 in response to information to be displayed.

On the other hand, at the steps 1 to 3, the positive voltage 27 with amplitude identical to that of the addressing pulses 26 is provided on all of the data electrodes 9; At step 4, the positive voltage 28 with level not exceeding that of the addressing pulses 26 is applied on all of the data electrodes 9.

By this time, the 4-electrode surface discharge type AC-PDP driving method in accordance with the present invention has been illustrated. The present invention can be applied to a 3-electrode surface discharge type AC-PDP.

Figure 5A:
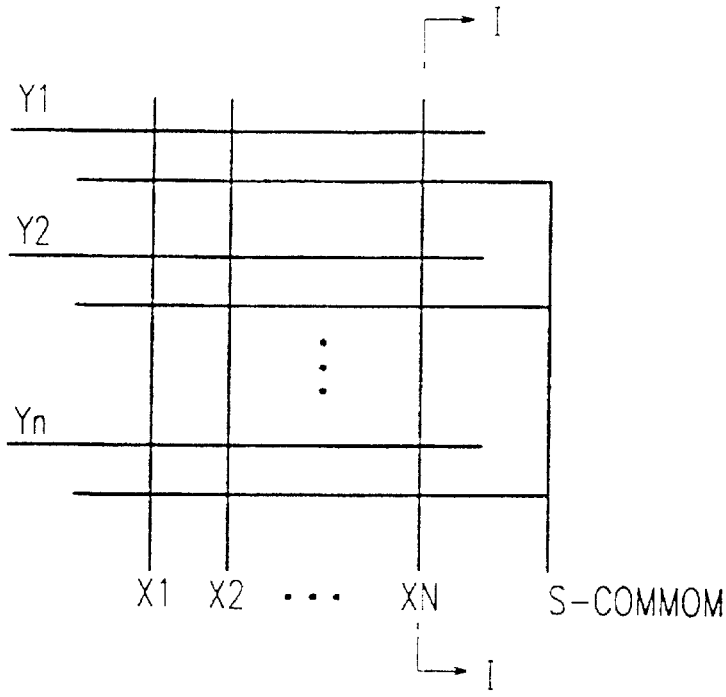
FIG. 5*a* illustrates an electrode array of an AC-type PDP of a 3 electrode surface discharge type.
Figure 5B:
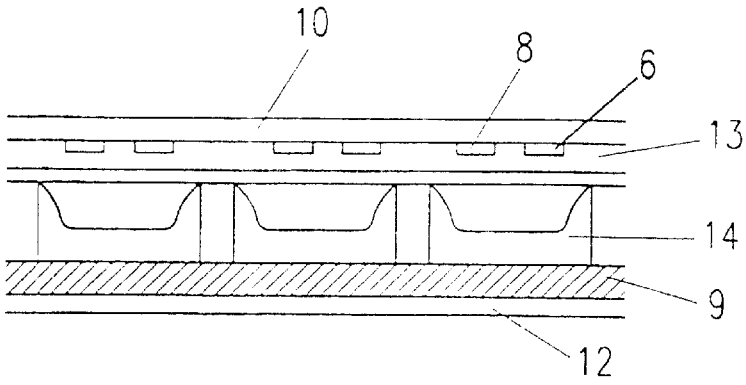
FIG. 5*b* represents a cross-sectional view of cutting the electrode array of the AC-type PDP in FIG. 5*a* along lines I—I.

FIGS. 5*a* and 5*b* show a structure of 3-electrodes surface discharge type AC-PDP, having the same structure as that of the 4-electrode surface discharge type AC-PDP shown in FIG. 1 except the second display electrodes 7. Therefore, it will be briefly illustrated hereinafter. The 3-electrode surface discharge type AC-PDP comprises a plurality of display lines, each display line having a scan electrode and a display electrode, wherein the scan electrodes 8 are connected to the scan driver 16 and the display electrodes 6 are commonly connected to the sustain driver 17. The scan driver 16 provides scanning pulses to the scan electrodes to designate pixels to be displayed in response to display information and the sustain driver 17 alternately provides sustaining pulses to the commonly connected display electrodes and the scan electrodes so as to display the designated pixels.

Figure 8A:
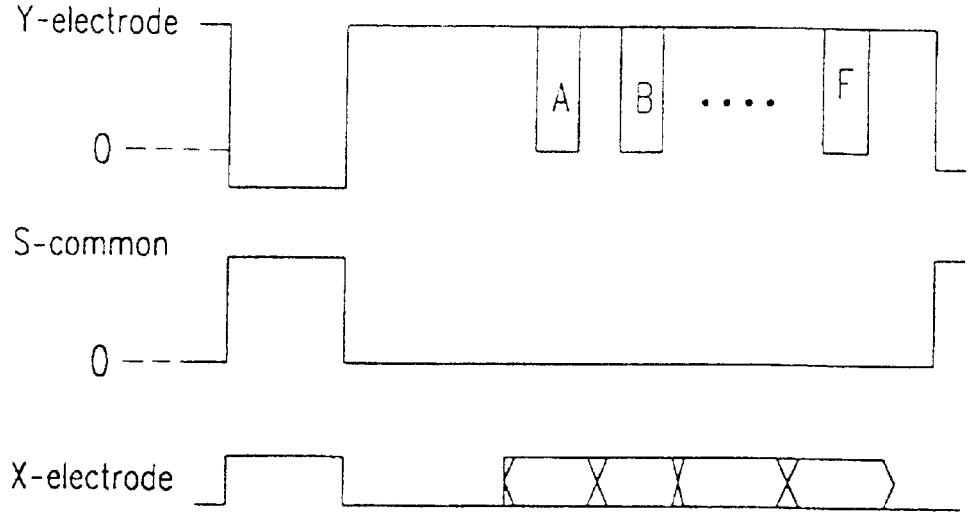
FIG. 8*a* represents a timing diagram of a selective erasing mode in accordance with the driving method of the present invention.
Figure 8B:
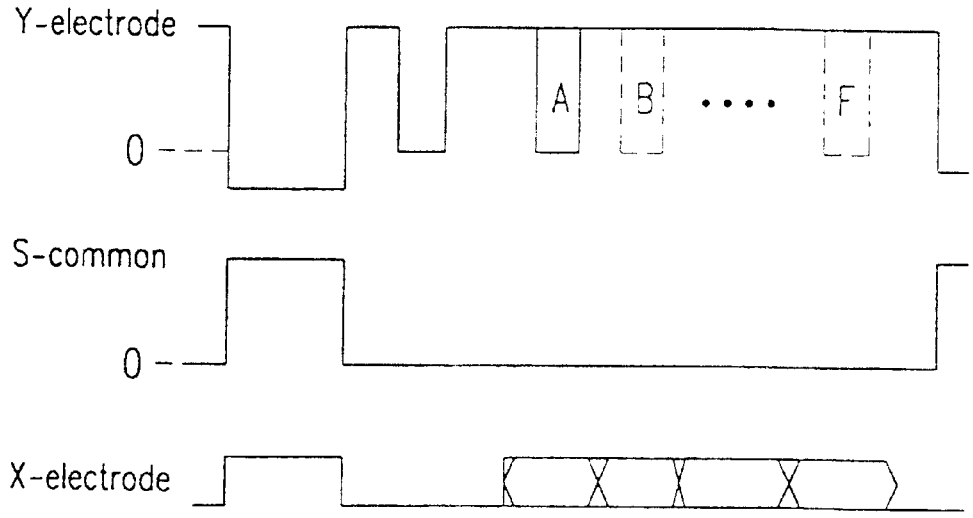
FIG. 8*b* depicts a timing diagram of a selective writing mode in accordance with the driving method of the present invention.
Figure 8C:
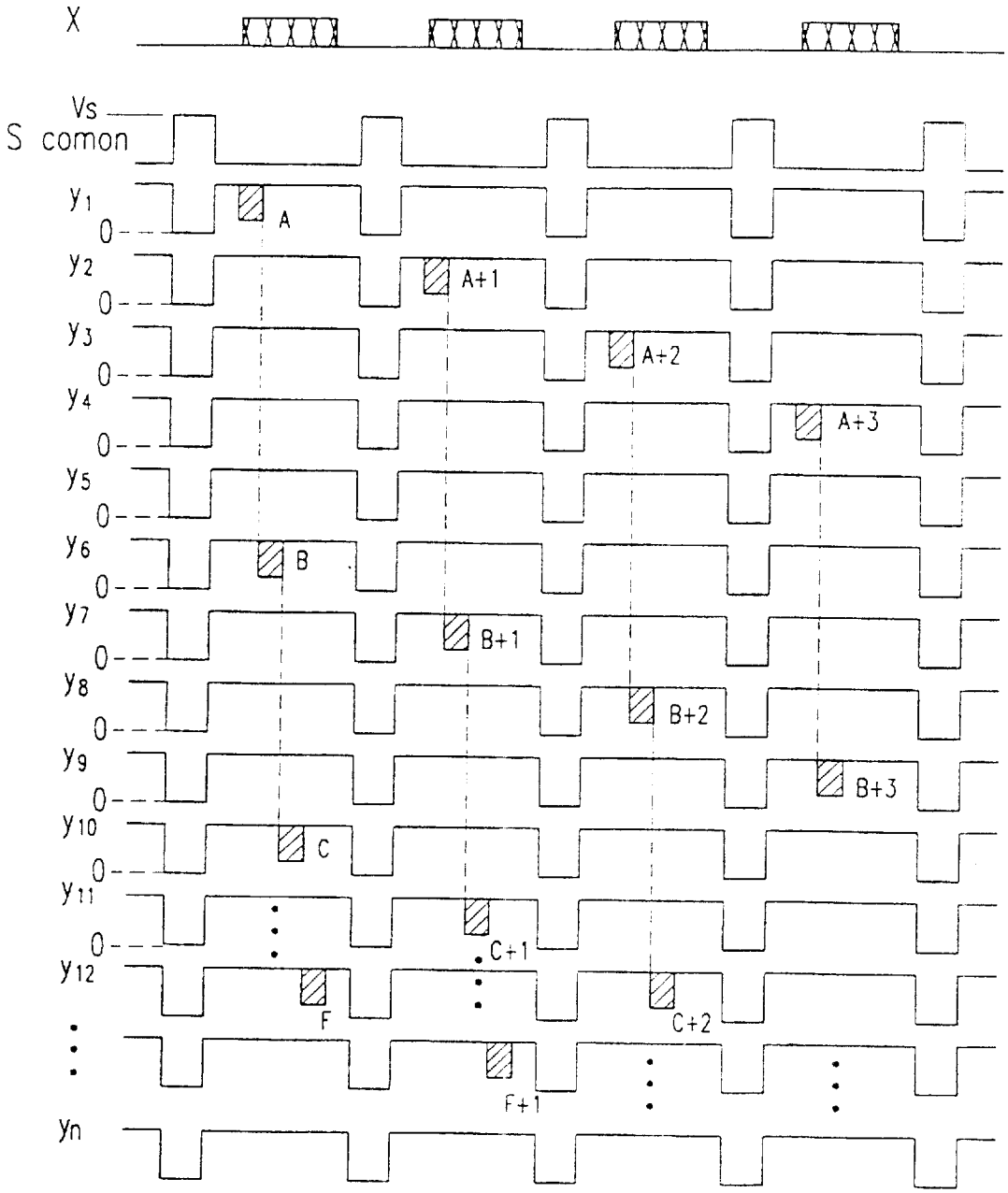
FIG. 8*c* shows a timing diagram representing continuous sustain pulses in accordance with the driving method of the present invention.

According to the present invention, a single image frame is divided into a plural number e.g., 6 number of subframes, each subframe having a specific sustaining periods i.e. a specific number of sustaining pulses in order to display a gray level. Then, after selecting 6 number of display lines among a plurality of display lines, wherein the number of the selected display lines is identical to the number of the divided subframes, each subframe is assigned to each of the selected display lines. As shown in FIGS. 8*a* and 8*b*, by applying a negative writing pulse below a reference voltage onto each selected scan electrodes of a selected display line and a positive writing pulse onto commonly connected display electrodes, all pixels of the selected display lines are turned on. In the selective erasing mode illustrated in FIG. 8*a*, in order to designate pixels of the selected display lines to be displayed according to data pulses provided onto data electrodes, scanning pulses A to F are sequentially provided on selected scan electrodes $Y_A$ to $Y_F$. On the other hand, in the selective writing mode described in FIG. 8*b*, after turning off all pixels of the selected display lines which are turned on by applying erasing pulses onto all of selected scan electrodes before scanning, scan pulses A to F are sequentially provided on selected scan electrodes $Y_A$ to $Y_F$In the above, the scanning pulses A to F have different phases and exist within one sustaining pulse. At the same time, addressing pulses are supplied onto data electrodes X in response to display information. Then, in order to display i.e sustain the designated pixels of the selected display lines, specific number of sustaining pulses is alternately applied on display electrodes and scan electrodes of the selected display lines. Next, after shifting one line or two lines from before-selected display lines, similarly before-mentioned steps, i.e. selection of display lines, assigning of specific subframe for the selected display lines, turning on of all pixels of the selected display lines, scanning of the selected display lines, and displaying or sustaining of the designated pixels of the selected display lines for each of the assigned subframes carry out. Therefore, if repeating shift above-mentioned and display a specific of subframe for selected display lines until each of subframes, i.g. 6 number of subframes for all display lines is displayed, display of an image frame is accomplished.

Figure 9A:
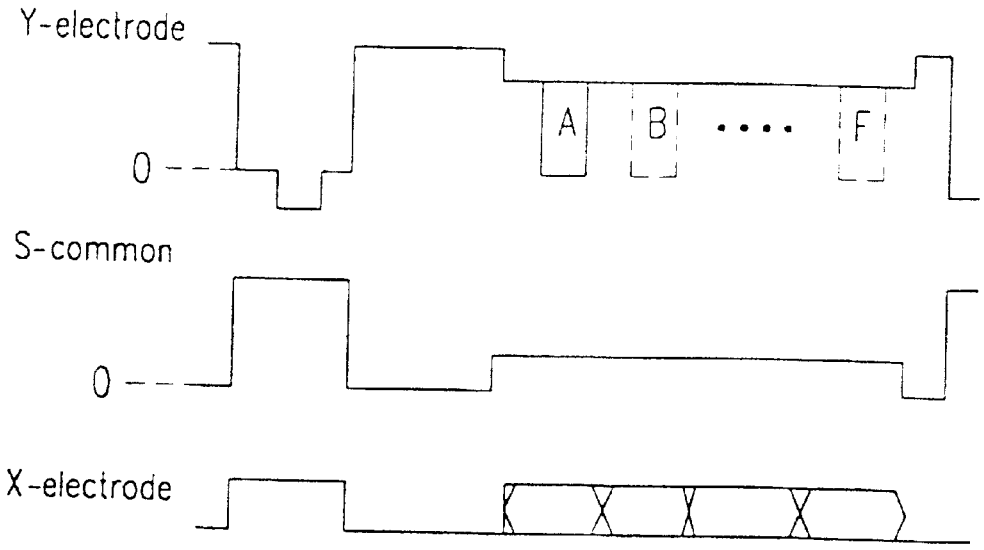
FIGS. 9*a* and 9*b* are timing diagrams in accordance with another embodiment of the present invention, respectively.
Figure 9B:
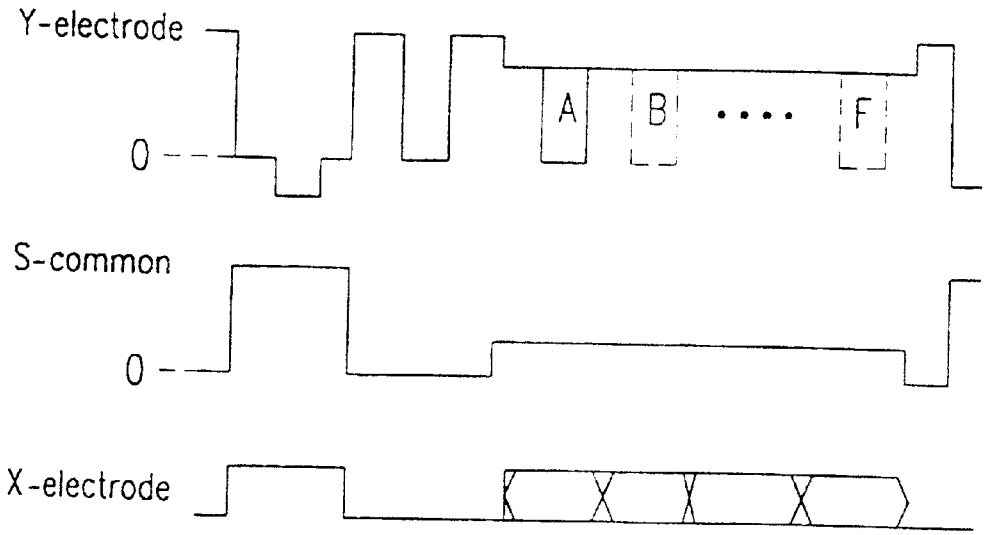

Referring to FIGS. 9*a* and 9*b*, there is described another embodiment of the present invention. A width of a negative writing pulse below a reference voltage shown in FIGS. 8*a* and 8*b* for turning on the all pixels of the selected display lines can be set as relatively narrow compared with a interval between adjacent two sustain pulses. Also, in a scanning process, a voltage level provided on all scan electrodes Y cab be set as lower than that of the sustaining pulse, and at the same time, a positive voltage level is applied onto the commonly connected display electrodes. As a result, it is possible to reduce voltage levels of a discharge voltage and an erasing voltage. In addition, it is also possible to prevent a discharge erasing error and a writing error.

Figure 6A:
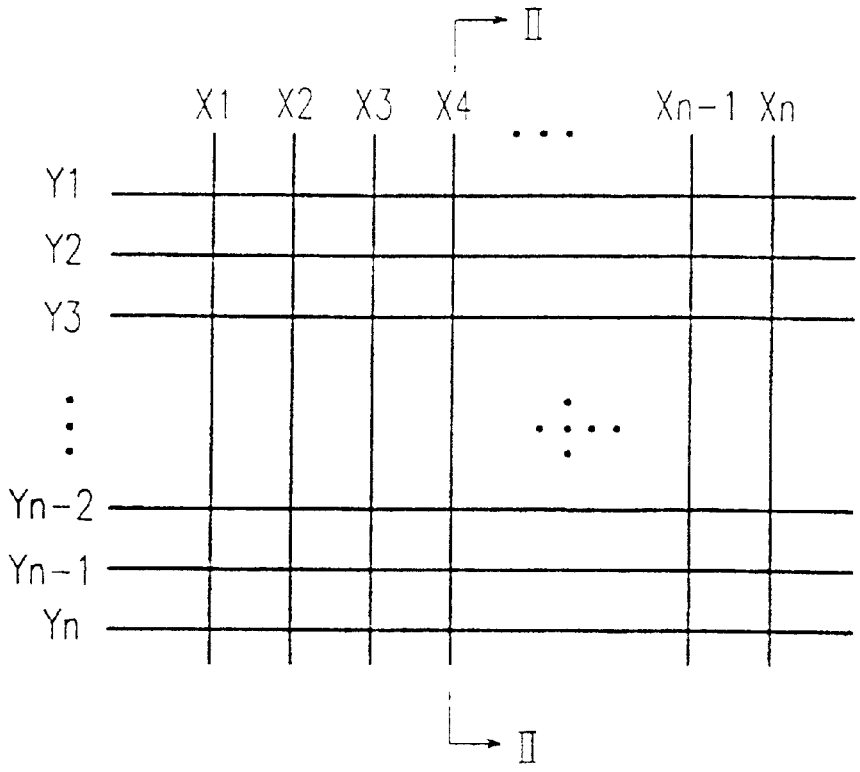
FIG. 6*a* describes an electrode array of an AC-type PDP of a 2 electrode opposed-discharge type.
Figure 6B:
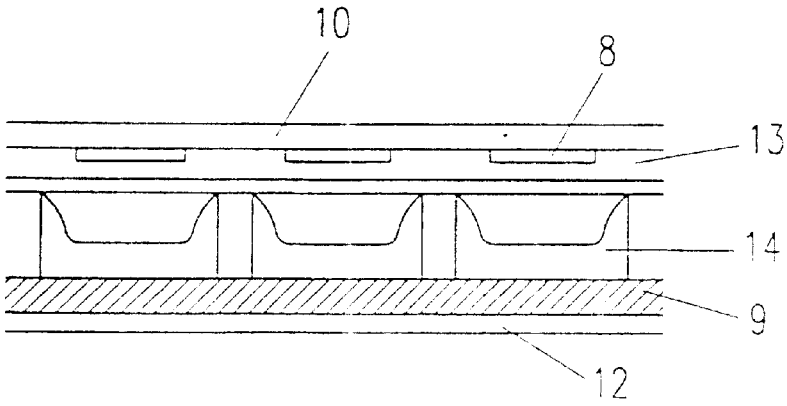
FIG. 6*b* shows a cross-sectional view of cutting the electrode array of the AC-type PDP in FIG. 6*a* along lines II—II.

The present invention can be also applied to 2-electrode type AC-PDP shown in FIGS. 6*a* and 6*b*. While 3-and 4-electrode surface discharge type AC-PDPs comprises independent display electrodes therein, 2-electrode type AC-PDP does not have.

As illustrated above, in embodiment of the present invention, a level of sustaining pulse has set as 140~170V, an addressing pulse 80~100V and a sustain period 32 $\mu$s. Also, 252 gray levels of display and luminance of 260 cd/sq.m have achieved. Furthermore, it is possible to drive an HDTV system as well as an NTSC system by increasing the number of subframes. It is possible to multi-scan at different scan points for each of the subframes and to concurrently display a given subframe and other subframe. As a result, it is possible to reduce suspending periods during processing a single image frame, and there are advantages of advanced driving stability, high luminance and improved contrast.

While the present invention has been described with respect to the particular embodiments, it will be apparent to those skilled in the art that various changes and modifications may be made without departing from the spirit and scope of the invention as defined in the following claims.

What is claimed is:

1. A method for driving an AC-type plasma display panel capable of displaying gray levels of an image frame which is divided into n number of subframes, each subframe having predetermined sustaining periods, wherein, for each sustaining period of the subframe, scanning pulses are provided onto selected scan electrodes, addressing pulses are supplied onto data electrodes in response to display information, and the number of sustaining pulses R included in two adjacent subframes of continuous subframes is determined as a rate of $R \geqq 2S/(n+2)$;

S represents the total number of sustaining pulses within an image frame and the number of sustaining pulses in a subframe is odd number;

each pixel including first and second display electrodes which are disposed in parallel, scan electrodes located close to the first and the second display electrodes and data electrodes perpendicular to the scan electrodes, a voltage pulse of each of the sustain periods is generated by the steps of:

(a) providing a positive sustaining pulse onto all of the second display electrodes;

(b) supplying the positive sustaining pulse onto all of the first display electrodes;

(c) providing a negative writing pulse onto selected scan electrodes, and at the same time providing the positive sustaining pulse onto all of the second display electrodes;

(d) providing sustaining pulses onto all of the scan electrodes;

(e) determining a voltage level, which is provided onto the second display electrodes and the scan electrodes, not greater than an amplitude of the sustaining pulse, subsequently providing negative scan pulses selected in a given sustaining period onto the scan electrodes and applying positive addressing pulses on the data electrodes in response to display information, wherein the voltage level in the steps (a) to (c) is determined to be identical to an amplitude of the addressing pulse and the voltage level in the step (d) is not greater than the amplitude of the addressing pulse; and the scan pulse provided onto the selected scan electrodes is a negative pulse and the voltage level on the data electrode is not greater than the amplitude of the addressing pulse.

2. A method for driving an AC-type plasma display panel comprising two substrates separated from each other, display electrodes and scan electrodes disposed on one of said two substrates in parallel, a plurality of display lines consisting of one scan electrode and one or more display electrodes, a dielectric layer covering the display and the scan electrodes, data electrodes disposed on the other of said two substrates substantially orthogonal to said display lines, a number of pixels formed on crossing points of a display line and a data electrode, spacers formed on one or both of said substrates to partition said pixels, and gas filled in a space between the two substrates, said method comprising the steps of:

(a) dividing a single image frame into n number of subframes, each of the subframes having predetermined number of sustaining pulses;

(b) selecting display lines whose number is identical to the number of said divided subframes, assigning specific subframes to said selected display lines, applying negative writing pulses onto scan electrodes of the selected display lines, at the same time, providing positive sustaining pulse onto commonly connected display electrodes, then providing positive sustaining pulses on the scan electrodes of said selected display lines, sequentially providing negative scanning pulses having different phases on the scan electrodes of said selected display lines and at the same time, applying positive addressing pulses on said data electrodes in response to display information in order to designate pixels to be displayed, and alternately supplying the predetermined number of positive sustaining pulses onto said selected scan electrodes and said commonly connected display electrodes, to thereby display said assigned subframes for each of said selected display lines;

(c) shifting by one or more display line(s) from each of said selected display lines, and (d) repeating said shifting of step (c) and displaying of said assigned subframes for selected display lines of step (b) until each of said divided subframes is displayed for all the display lines, to thereby display a image frame, wherein, at the step (b), widths of the negative writing pulses provided onto the selected scan electrodes is narrower than interval between two adjacent sustaining pulses provided onto the scan electrodes.

3. The method recited in claim 2, wherein, at the step (b), during providing the negative scan pulses onto the selected scan electrodes, a voltage level of positive sustaining pulses applied onto the selected scan electrode is maintained below a voltage level of the other sustaining pulse and at the same time, a fixed level of positive voltage is provided onto said commonly connected display electrodes.

4. The method as recited in claim 2, wherein at said step (b), before providing negative scanning pulses having different phases on the scan electrodes of said selected display lines, a constant width of erasing pulses applied onto said selected scan electrodes to erase, i.e. turn off said pixels.

5. The method as recited in claim 2, wherein, said display of assigned subframe for selected display lines continuous carries out twice.

6. The method as recited in claim 2, wherein said scan pulses on the scan electrodes are generated by control micro-circuits having "γ" outputs, respectively, each control micro-circuit including a shift register, and in a given sustaining period, scanning pulse is formed only on one of the outputs of the control micro-circuits.

7. The method as recited in claim 6, wherein the "γ" value being determined as $\gamma \leqq R/2$, γ represents the number of outputs of the control micro-circuit and R represents the total number of the sustain pulses of the adjacent two subframes.

8. The method as recited in claim 6, wherein odd scan electrodes and even scan electrodes are separately connected to the control micro-circuit.

* * * * *